US010053259B2

(12) United States Patent
Gungner

(10) Patent No.: US 10,053,259 B2
(45) Date of Patent: Aug. 21, 2018

(54) CONSTRUCT WITH LOCKING FEATURES

(71) Applicant: Graphic Packaging International, Inc., Atlanta, GA (US)

(72) Inventor: Greg Gungner, Ontario (CA)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/051,889

(22) Filed: Feb. 24, 2016

(65) Prior Publication Data

US 2016/0251108 A1 Sep. 1, 2016

Related U.S. Application Data

(60) Provisional application No. 62/176,795, filed on Feb. 27, 2015.

(51) Int. Cl.

| | |
|---|---|
| ***B65D 5/68*** | (2006.01) |
| ***B31B 1/60*** | (2006.01) |
| ***B31B 1/90*** | (2006.01) |
| ***B65D 5/20*** | (2006.01) |
| ***B31B 50/60*** | (2017.01) |
| ***B31B 50/81*** | (2017.01) |
| *B31B 50/73* | (2017.01) |

(52) U.S. Cl.

CPC ..... *B65D 5/685* (2013.01); *B31B 50/60* (2017.08); *B31B 50/81* (2017.08); *B65D 5/20* (2013.01); *B65D 5/2028* (2013.01); *B65D 5/2047* (2013.01); *B65D 5/68* (2013.01); *B31B 50/734* (2017.08); *B31B 50/814* (2017.08)

(58) Field of Classification Search

CPC .. B65D 5/685; B65D 5/20; B65D 5/68; B31B 1/60; B31B 1/90; B31B 2201/6095; B31B 2201/9061

USPC ..... 229/125.36, 114, 125.19, 148, 150, 229/125.28, 144, 149, 193, 186, 187, 188

See application file for complete search history.

(56) References Cited

U.S. PATENT DOCUMENTS

| | | | |
|---|---|---|---|
| 1,048,577 | A | 12/1912 | Pardoe |
| 1,656,919 | A | 1/1928 | Marsh |
| 1,793,102 | A | 2/1931 | Labombarde |
| 1,901,483 | A | 3/1933 | Ware, Jr. |

(Continued)

FOREIGN PATENT DOCUMENTS

| | | |
|---|---|---|
| DE | 1 586 447 | 4/1970 |
| DE | 2 320 190 | 11/1973 |

(Continued)

OTHER PUBLICATIONS

International Search Report and Written Opinion for PCT/US2016/019241 dated Jun. 24, 2016.

*Primary Examiner* — Christopher Demeree

(74) *Attorney, Agent, or Firm* — Womble Bond Dickinson (US) LLP

(57) ABSTRACT

A construct for holding at least one article. The construct comprises a plurality of panels extending at least partially around an interior of the construct. The plurality of panels can at least partially form a corner of the construct. The construct further comprises locking features for at least partially interlocking the construct with a separate construct. The locking features can comprise at least a locking tab and an engagement aperture, and the locking tab can be proximate the engagement aperture at the corner of the construct.

57 Claims, 7 Drawing Sheets

(56) References Cited

U.S. PATENT DOCUMENTS 1,925,102 A 9/1933 Levkoff
2,027,079 A 1/1936 Weiss
2,054,596 A 9/1936 Ford
2,141,743 A 12/1938 Ethridge
2,145,430 A 1/1939 New
2,152,079 A 3/1939 Mott
2,180,808 A 11/1939 Jacobstein et al.
2,194,220 A 3/1940 Elder
2,654,526 A * 10/1953 McReary ..... B65D 5/241 229/144
2,777,630 A 1/1957 Moberger
2,835,594 A 5/1958 Felt et al.
2,877,736 A 3/1959 Simmons
2,887,389 A 5/1959 Linville
2,964,231 A 12/1960 Hanselman, Jr. et al.
2,990,992 A 7/1961 Ellis
2,999,626 A 9/1961 McDermott
3,002,613 A 10/1961 Merkel
3,027,062 A 3/1962 Huss et al.
3,071,882 A 1/1963 Eisman et al.
3,099,381 A 7/1963 Meyers
3,131,851 A 5/1964 Pace
3,131,852 A 5/1964 Forbes, Jr.
3,139,979 A 7/1964 Russell
3,164,316 A 1/1965 Wurster et al.
3,181,772 A 5/1965 Collins et al.
3,185,382 A 5/1965 Nunn
3,193,175 A 7/1965 Moreton
3,205,603 A 9/1965 Brumley
3,206,096 A 9/1965 Struble
3,206,103 A 9/1965 Bixler
3,215,332 A 11/1965 Bess
3,228,710 A 1/1966 Chodorowski
3,263,900 A 8/1966 Link et al.
3,276,665 A 10/1966 Rasmussen
3,280,968 A 10/1966 Craine
3,310,222 A 3/1967 Buttery
3,310,223 A 3/1967 Buttery
3,325,081 A 6/1967 Mahon
3,409,205 A 11/1968 Meyers
3,410,476 A 11/1968 Buttery
3,524,581 A 8/1970 Buttery
3,596,823 A 8/1971 Zitzelman
3,653,495 A 4/1972 Gray
3,677,458 A 7/1972 Gosling
3,693,865 A 9/1972 Desmond et al.
3,734,390 A 5/1973 Buttery et al.
3,759,378 A 9/1973 Werth
3,786,914 A 1/1974 Beutler
3,795,360 A * 3/1974 Bianchi ..... B65D 43/0212 220/786
3,809,305 A * 5/1974 Persson ..... B65D 5/64 220/315
3,840,172 A 10/1974 Zimmermann
3,884,438 A 5/1975 Logsdon
3,958,744 A 5/1976 Herglotz
3,981,434 A 9/1976 Ramich
D241,821 S 10/1976 Jewell
4,004,691 A 1/1977 Wihksne
4,008,849 A 2/1977 Baber
4,046,313 A 9/1977 Perry
4,111,297 A 9/1978 Paulin
4,113,100 A 9/1978 Soja
4,232,816 A 11/1980 Johnson et al.
4,266,713 A 5/1981 Maroszek
4,271,964 A 6/1981 Train
4,289,240 A 9/1981 Mueller
4,470,538 A 9/1984 Heathcock et al.
4,472,896 A 9/1984 Brauner et al.
4,519,538 A 5/1985 Omichi
4,558,785 A 12/1985 Gordon
4,570,845 A 2/1986 Hall
4,630,733 A 12/1986 Fear
4,669,614 A 6/1987 Froom
4,684,023 A 8/1987 Cortopassi
4,717,070 A 1/1988 Taub
4,742,917 A 5/1988 Bornwasser
4,749,086 A 6/1988 Donohie
4,757,902 A 7/1988 Hutchinson et al.
4,773,541 A 9/1988 Riddell
4,792,085 A 12/1988 Waring et al.
4,793,487 A 12/1988 Bentsen et al.
4,804,137 A 2/1989 Harby
4,815,609 A 3/1989 Kiedaisch
4,856,707 A 8/1989 Lorenz
4,886,160 A 12/1989 Kligerman
4,901,457 A 2/1990 Chandler
4,907,698 A 3/1990 Konrad et al.
4,913,291 A 4/1990 Schuster
4,930,681 A 6/1990 Fultz et al.
4,944,407 A 7/1990 Thiele et al.
5,037,026 A 8/1991 Hanko
D320,743 S 10/1991 Alexander et al.
5,058,803 A 10/1991 Gulliver
5,060,851 A 10/1991 Lorenz
5,097,958 A 3/1992 Josephs et al.
RE33,979 E 6/1992 Cortopassi
5,160,081 A 11/1992 Beales
5,181,650 A 1/1993 Hollander et al.
5,188,284 A 2/1993 Eisman
D342,446 S 12/1993 Parker et al.
D344,023 S 2/1994 Eisman
D346,552 S 5/1994 Krupa
D348,609 S 7/1994 Eisman et al.
5,330,099 A 7/1994 Beales et al.
5,332,147 A 7/1994 Sorenson
5,364,018 A 11/1994 Carlsson
5,368,194 A 11/1994 Oliff et al.
5,388,758 A 2/1995 Scovell
D365,272 S 12/1995 Krupa et al.
5,484,102 A 1/1996 DeMay
5,662,265 A 9/1997 Jensen
5,690,273 A 11/1997 Jensen
5,692,672 A 12/1997 Hunt
5,697,549 A 12/1997 Yocum
5,699,957 A 12/1997 Blin et al.
5,722,583 A 3/1998 Focke et al.
5,788,117 A 8/1998 Zimmanck
5,788,145 A 8/1998 Grahahm et al.
5,826,781 A 10/1998 Jensen
5,842,576 A 12/1998 Snow
5,857,570 A 1/1999 Brown
5,878,947 A 3/1999 Hoy et al.
5,881,884 A 3/1999 Podosek
5,921,398 A 7/1999 Carroll
5,927,498 A 7/1999 Saam
5,979,749 A 11/1999 Bozich
6,027,018 A 2/2000 Yocum
6,041,997 A 3/2000 Jensen
6,068,181 A 5/2000 Cai
6,092,719 A 7/2000 Capo
D431,462 S 10/2000 Menaged et al.
6,129,211 A 10/2000 Prakken et al.
6,135,289 A 10/2000 Miller
6,349,875 B1 2/2002 Whitnell
6,386,441 B2 5/2002 Philips
D458,127 S 6/2002 de Groote
D460,691 S 7/2002 Morris et al.
6,419,152 B1 7/2002 Tokarski
6,435,351 B1 8/2002 Gibb
6,478,159 B1 11/2002 Taylor
6,481,259 B1 11/2002 Durney
D467,499 S 12/2002 Garza et al.
6,510,982 B2 1/2003 White
6,523,692 B2 2/2003 Gregory
D473,787 S 4/2003 Jones, Jr. et al.
D484,043 S 12/2003 Hwang et al.
6,681,983 B2 1/2004 Bill-Moore
6,834,793 B2 12/2004 Sutherland
6,913,189 B2 7/2005 Oliff et al.
6,913,190 B2 7/2005 Ruhbusch et al.
6,923,365 B2 8/2005 Auclair et al.
7,021,468 B2 4/2006 Cargile
7,225,930 B2 6/2007 Ford et al.

(56) References Cited

U.S. PATENT DOCUMENTS

| | | | |
|---|---|---|---|
| 7,232,054 | B2 | 6/2007 | Yocum |
| 7,328,834 | B2 | 2/2008 | Harrelson |
| 7,416,109 | B2 | 8/2008 | Sutherland |
| 7,669,755 | B2 | 3/2010 | Smalley |
| 7,743,944 | B2 | 6/2010 | Ho Fung et al. |
| 7,784,675 | B2 | 8/2010 | Sutherland et al. |
| 7,980,452 | B2 | 7/2011 | Burton |
| 8,006,893 | B2 | 8/2011 | Burke et al. |
| 8,056,799 | B2 | 11/2011 | Burke et al. |
| 8,672,215 | B2 | 3/2014 | Learn |
| 8,733,626 | B2 | 5/2014 | Learn |
| 8,740,050 | B2 | 6/2014 | Zinck et al. |
| 9,139,330 | B2 | 9/2015 | Gomez |
| 2001/0001447 | A1 | 5/2001 | Gregory |
| 2002/0043554 | A1 | 4/2002 | White et al. |
| 2002/0170845 | A1 | 11/2002 | Oliff |
| 2003/0047595 | A1 | 3/2003 | Bill-Moore |
| 2004/0074953 | A1 | 4/2004 | Yocum |
| 2004/0099570 | A1 | 5/2004 | Cargile |
| 2005/0092649 | A1 | 5/2005 | Ford et al. |
| 2005/0199690 | A1 | 9/2005 | Peterson |
| 2006/0243739 | A1 | 11/2006 | Sherman et al. |
| 2006/0266815 | A1 | 11/2006 | Coltri-Johnson et al. |
| 2007/0000934 | A1 | 1/2007 | Wolpow |
| 2007/0012755 | A1 | 1/2007 | Metcalf |
| 2007/0108262 | A1 | 5/2007 | D'Amato |
| 2007/0267467 | A1 | 11/2007 | Burke et al. |

FOREIGN PATENT DOCUMENTS

| | | |
|---|---|---|
| EP | 0 520 131 | 12/1992 |
| EP | 0 704 386 | 4/1996 |
| FR | 1 379 931 | 12/1963 |
| FR | 2 659 062 | 9/1991 |
| GB | 1 218 016 | 1/1971 |
| GB | 2 321 237 | 7/1998 |
| JP | S52-039054 | 3/1952 |
| JP | S52-096178 | 8/1977 |
| JP | S54-079106 | 6/1979 |
| JP | H06-87221 | 12/1994 |
| JP | H7-28016 | 5/1995 |
| JP | 07-315371 A | 12/1995 |
| JP | H08-113246 | 5/1996 |
| JP | 2002-87427 | 3/2002 |
| WO | WO 92/06896 | 4/1992 |
| WO | WO 98/31593 | 7/1998 |
| WO | WO 03/082686 | 10/2003 |
| WO | WO 2004/063031 | 7/2004 |
| WO | WO 2005/110866 | 11/2005 |
| WO | WO 2006/073506 | 7/2006 |

* cited by examiner

CONSTRUCT WITH LOCKING FEATURES

CROSS-REFERENCED TO RELATED APPLICATIONS

This application claims the benefit of U.S. Provisional Patent Application No. 62/176,795, filed on Feb. 27, 2015.

INCORPORATION BY REFERENCE

The disclosure of U.S. Provisional Patent Application No. 62/176,795, which was filed on Feb. 27, 2015, is hereby incorporated by reference for all purposes as if presented herein in its entirety.

BACKGROUND OF THE DISCLOSURE

The present disclosure generally relates to cartons, trays, and/or other constructs for holding food products and/or other types of articles. More specifically, the present disclosure relates to constructs that may include interlocking features.

SUMMARY OF THE DISCLOSURE

In general, one aspect of the disclosure is generally directed to a construct for holding at least one article. The construct comprises a plurality of panels extending at least partially around an interior of the construct. The plurality of panels can at least partially form a corner of the construct. The construct further comprises locking features for at least partially interlocking the construct with a separate construct. The locking features can comprise at least a locking tab and an engagement aperture, and the locking tab can be proximate the engagement aperture at the corner of the construct.

In another aspect, the disclosure is generally directed to a package for holding at least one article. The package can comprise a first construct forming a tray of the package. The tray can comprise a plurality of tray panels extending at least partially around an interior of the package, a tray locking tab, and a tray engagement aperture. The plurality of tray panels can at least partially form a tray corner, the tray locking tab can extend from a tray panel of the plurality of tray panels at the tray corner, and the tray engagement aperture can extend at the tray corner. A second construct can form a lid of the package. The lid can comprise a plurality of lid panels extending at least partially around an interior of the package, a lid locking tab, and a lid engagement aperture. The plurality of lid panels can at least partially form a lid corner, the lid locking tab can extend from a lid panel of the plurality of lid panels at the lid corner, and the lid engagement aperture can extend at the lid corner. The lid locking tab and the lid engagement aperture can be for selectively engaging the respective tray engagement aperture and tray locking tab to at least partially interlock the tray and the lid.

In another aspect, the disclosure is generally directed to a blank for forming a construct for holding at least one article. The blank can comprise a plurality of panels for being disposed at least partially around an interior of the construct formed from the blank to at least partially form a corner of the construct formed from the blank. The blank further can comprise locking features for at least partially interlocking the construct formed from the blank with a separate construct. The locking features can comprise at least a locking tab and an engagement aperture. The locking tab can be proximate the engagement aperture at the corner when the construct is formed from the blank.

In another aspect, the disclosure is generally directed to a method of forming a construct. The method can comprise obtaining a blank comprising a plurality of panels and locking features. The locking features can comprise at least a locking tab and an engagement aperture. The method further can comprise positioning the panels of the plurality of panels to extend at least partially around an interior of the construct. The positioning the panels can comprise forming a corner of the construct, wherein the locking tab is proximate the engagement aperture at the corner of the construct.

In another aspect, the disclosure is generally directed to a method of forming an assembly. The method can comprise obtaining a first construct and a second construct. The first construct can form a tray of the package. The tray can comprise a plurality of tray panels extending at least partially around an interior of the package, a tray locking tab, and a tray engagement aperture. The plurality of tray panels can at least partially form a tray corner, the tray locking tab can extend from a tray panel of the plurality of tray panels at the tray corner, and the tray engagement aperture can extend at the tray corner. The second construct can form a lid of the package. The lid can comprise a plurality of lid panels extending at least partially around an interior of the package, a lid locking tab, and a lid engagement aperture. The plurality of lid panels can at least partially form a lid corner, the lid locking tab can extend from a lid panel of the plurality of lid panels at the lid corner, and the lid engagement aperture can extend at the lid corner. The method further can comprise at least partially interlocking the first construct with the second construct by disposing at least one of the lid locking tab and the tray locking tab to be at least partially received in the respective tray engagement aperture and lid engagement aperture.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The package or assembly of the present disclosure can be useful in containing one or more products (e.g., a food product) or other articles such as any suitable type of product that can be stored, transported, cooled, frozen, heated, and/or cooked (e.g., in a microwave oven). Some suitable products could comprise a sandwich, hot dog, French fries, nachos, fruits, vegetables, popcorn, cuts of meat, or any other suitable food product or other article. Further, the package of the present disclosure can be used for heating, cooking, browning, crisping, etc. the food product by use of a heating or cooking device such as a microwave oven. It is understood that food products (or non-food products) other than the food products listed herein may be contained in the package. Further, products contained in this package may be generally rectangular, triangular, round, square, irregular, or any other shape. In this specification, the terms "inner," "interior," "outer," "exterior," "lower," "bottom," "upper," and "top" indicate orientations determined in relation to fully erected and upright packages.

Figure 1:
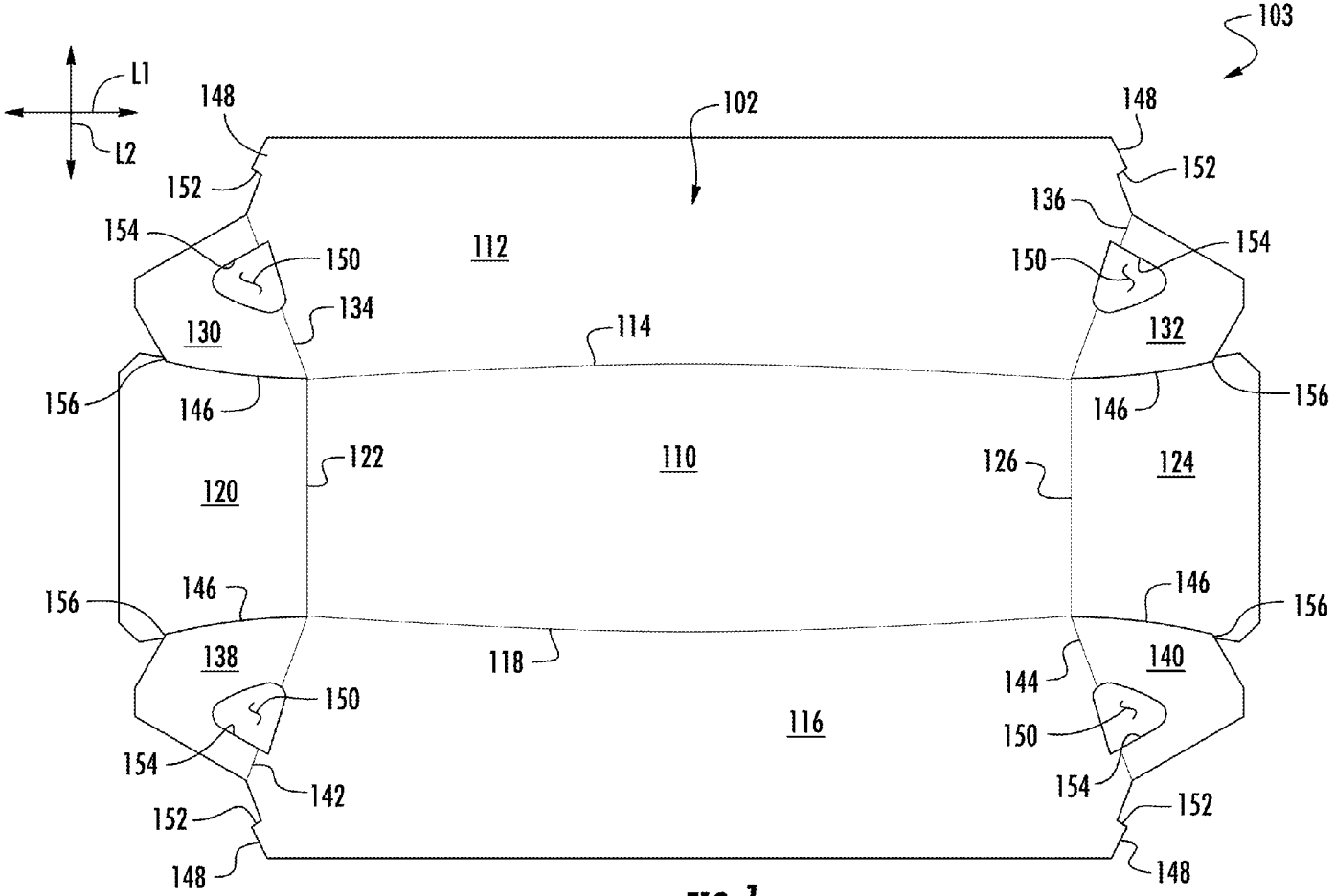
FIG. 1 is an exterior plan view of a blank used to form a construct according to an exemplary embodiment of the present disclosure.
Figure 2:
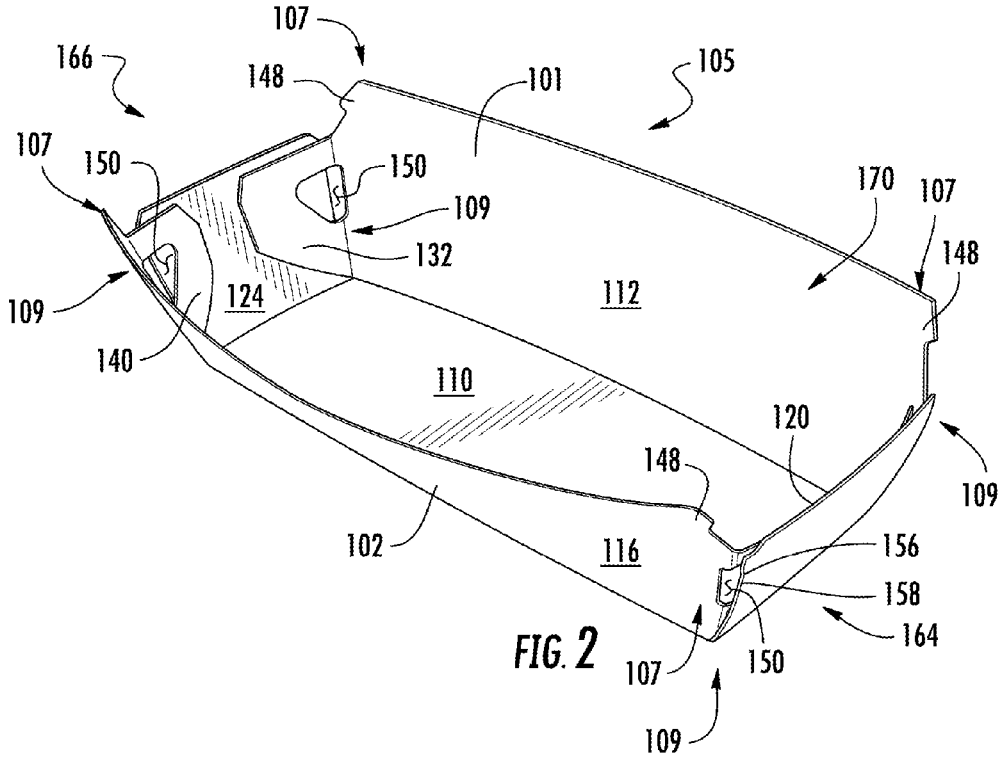
FIG. 2 is a top perspective view of an erected construct according to the exemplary embodiment of the present disclosure.
Figure 3:
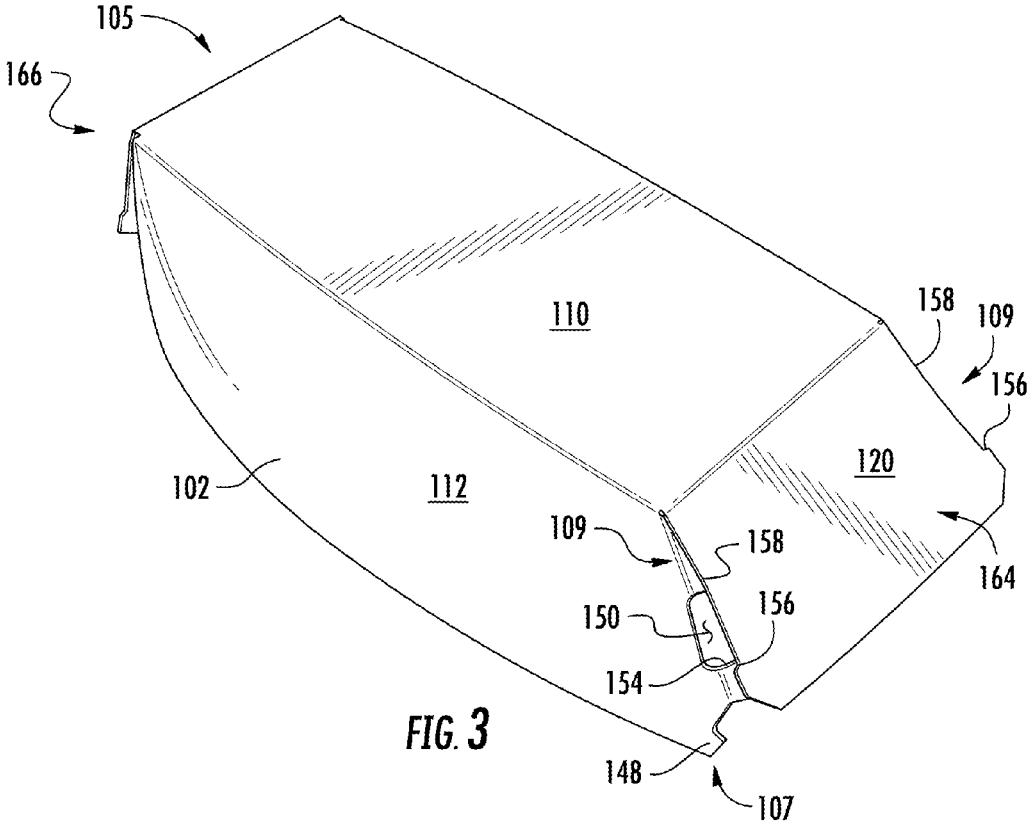
FIG. 3 is a bottom perspective view of the construct of FIG. 2.

FIG. 1 is a plan view of a blank, generally indicated at 103, used to form a construct 105 (FIGS. 2-5) of an exemplary embodiment of the disclosure. In one embodiment, two constructs 105, which can be identical, substantially identical, generally identical, or similar to one another, can form a respective lid 105*a* and tray 105*b* of a package 178 and can be interlocked to form an assembly 180 (FIGS. 6-9). The construct 105 can include locking features 107 at each corner 109 so that the two constructs can be at least partially interlocked in the assembly 180. In the illustrated embodiment, the blank 103 and the construct 105 can have an interior surface 101 (FIGS. 2 and 4) and an exterior surface 102 (FIGS. 1-3). The construct 105 is used to hold and/or support and/or cover a food product (not shown), such as a French bread pizza, sandwich, hot dog, turnover, burrito, meats, French fries, and/or any other food product, during serving (e.g., at a quick-service and/or takeout restaurant), cooking, refrigerating, freezing, etc. of the food product. In one embodiment, at least a portion of the construct 105 may have an element (not shown) for use in cooking, heating, browning, and/or shielding (e.g., a microwave energy interactive element, such as, but not limited to, a susceptor) mounted thereto. Alternatively, a microwave energy interactive element can be omitted from the construct 105. In an alternative embodiment, the construct 105 can hold and/or support and/or cover a non-food item or article.

The blank 103 has a longitudinal axis L1 and a lateral axis L2. The blank 103 includes a central panel 110 foldably connected to a first side panel 112 at a first longitudinal fold line 114. A second side panel 116 is foldably connected to the central panel 110 along a second longitudinal fold line 118. In the illustrated embodiment, the longitudinal fold lines 114, 118 are slightly curved so that the middle of central panel 110 bulges outwardly somewhat. Alternatively, the longitudinal fold lines 114, 118 could be straight or could be alternatively curved without departing from the disclosure. A first end panel 120 is foldably connected to the central panel 110 along a first lateral fold line 122 at one longitudinal end of the central panel 110, and a second end panel 124 is foldably connected to the central panel 110 along a second lateral fold line 126 at another longitudinal end of the central panel 110.

In the illustrated embodiment, the blank 103 includes end flaps 130, 132 foldably connected at respective ends of the first side panel 112 along respective fold lines 134, 136. End flaps 138, 140 are respectively foldably connected at respective ends of the second side panel 116 along the respective fold lines 142, 144. In one embodiment, each of the end flaps 130, 138, 132, 140 is at least partially separable from the respective end panel 120, 124 along respective cut lines 146. The blank 103 could be otherwise shaped, arranged, positioned, and/or configured without departing from the disclosure. For example, the end flaps 130, 138, 132, 140 could be foldably connected to the respective end panels 120, 124. Alternatively, the end flaps 130, 132, 138, 140 could be omitted from the blank 103 without departing from the disclosure.

As shown in FIG. 1, the locking features 107 can include a locking projection or locking tab 148 disposed at each end of each of the side panels 112, 116 and an opening or engagement aperture 150 extending in each of the end flaps 130, 132, 138, 140 and into the respective side panels 112, 116. The locking features 107 can also include an engagement notch 156 on each side of each of the end panels 120, 124. The engagement notches 156 can be formed by each of the cut lines 146. Each of the locking tabs 148 can include a respective locking edge 152, and each of the engagement apertures 150 can include a respective engagement edge 154. Accordingly, when two constructs 105 are assembled into an interlocking relationship (e.g., FIGS. 7-9), the locking tabs 148 of one construct 105 can be at least partially received in the respective engagement apertures 150 of the other construct 105 so that the locking edges 152 of the first construct engage the respective engagement edges 154 and/or engagement notches 156 of the second construct. Any of the locking features 107 could be omitted or could be otherwise shaped, arranged, positioned, and/or configured without departing from the disclosure. For example, the engagement apertures 150 could be disposed in the respective end flaps 130, 132, 138, 140 adjacent the respective fold lines 134, 136, 142, 144 so that the engagement apertures do not interrupt the fold lines and extend into the side panels 112, 116. In another example, the engagement notches 156 could be formed in edges of the end panels 120, 124 that are spaced from the respective cut lines 146 and/or the respective end flaps 30, 132, 138, 140.

Figure 4:
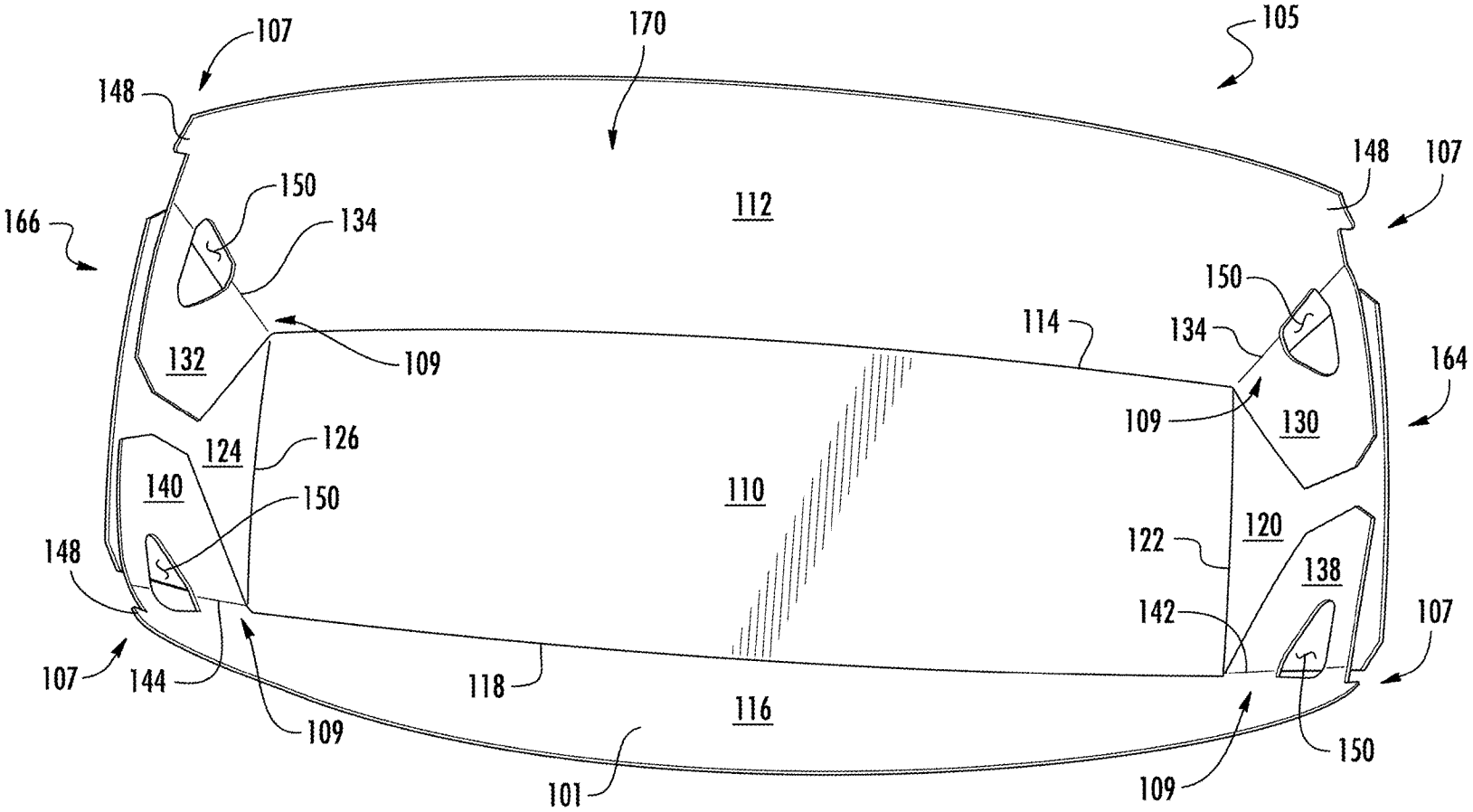
FIG. 4 is a perspective view of an interior of the construct of FIG. 2.
Figure 5:
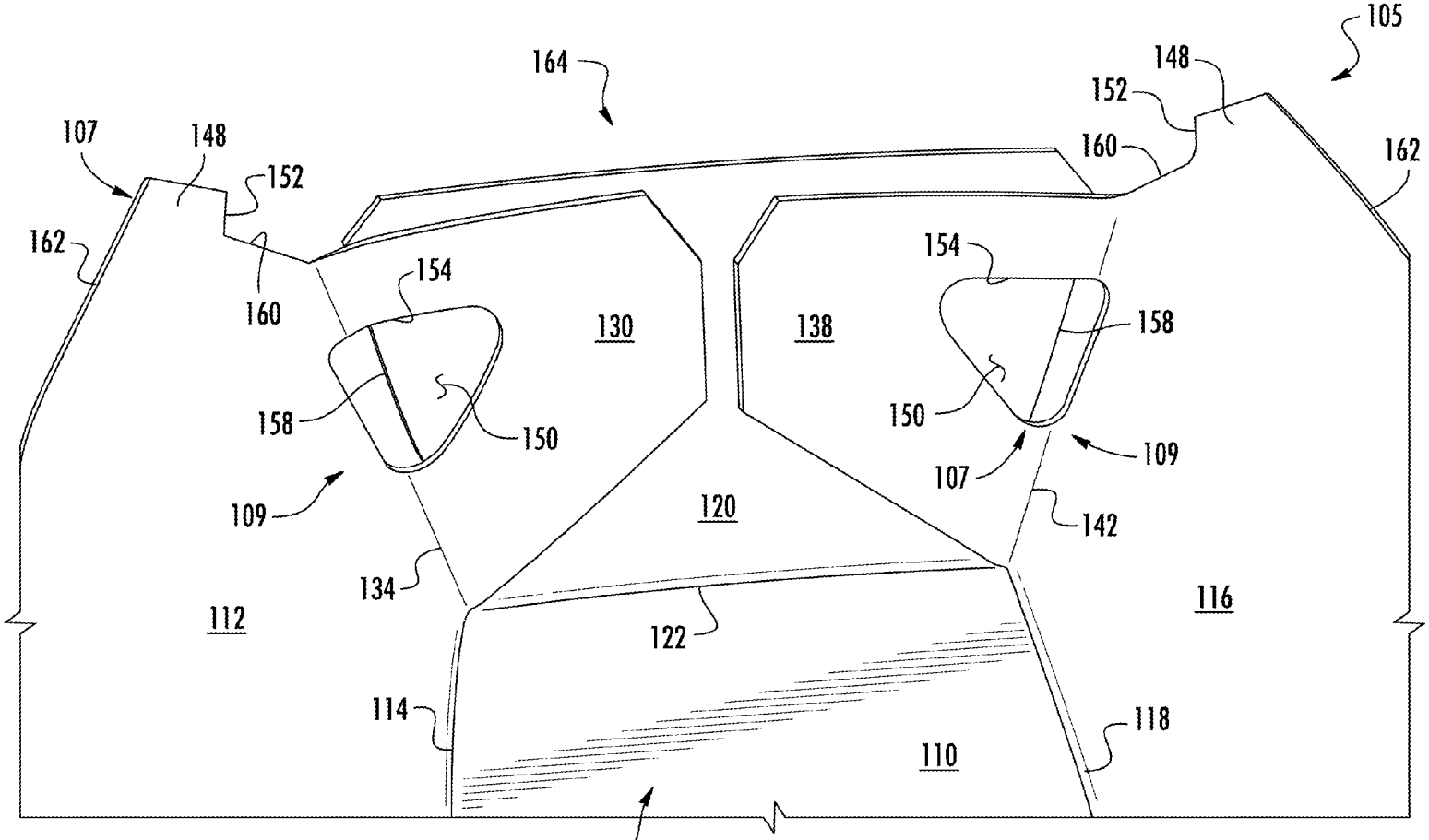
FIG. 5 is an interior perspective view of an end of the construct of FIG. 2.

As shown in FIGS. 2-5 and described in the following in accordance with one acceptable example, the construct 105 is formed from the blank 103 by first upwardly folding the side panels 112, 116 along the respective longitudinal fold lines 114, 118 and folding the end panels 120, 124 along the respective lateral fold lines 122, 126. Each of the end flaps 130, 138 can be folded along the respective lateral fold lines 134, 142 into face-to-face contact with the interior surface of the first end panel 120 and at least partially glued and/or otherwise secured to the first end panel 120 (FIGS. 4 and 5). Additionally, each of the end flaps 132, 140 can be folded along the respective lateral fold lines 136, 144 into face-to-face contact with the interior surface of the second end panel 124 and at least partially glued and/or otherwise secured to the second end panel 124 (FIGS. 2 and 4). Accordingly, the first end panel 120 and the end flaps 130, 132 cooperate to form a first closed end 164 of the tray 105, and the second end panel 124 and the end flaps 138, 140 cooperate to form a second closed end 166 of the tray 105. In addition, as shown in FIGS. 2-5, the four corners 109 of the construct 105 are formed at the respective junctions between each of the side panels 112, 116 and the respective closed ends 164, 166 so that the fold lines 134, 136, 142, 144 extend along each of the corners 109. In the illustrated embodiment, the locking features 107 are disposed in each of the corners 109 (FIGS. 2-5). As shown in FIGS. 2 and 4, the central panel 110, the side panels 112, 116, and the closed ends 164, 166 form an interior 170 of the tray 105.

In the illustrated embodiment, as the end panels 120, 124 and the end flaps 130, 132, 138, 140 are folded relative to one another, the end panel 120 separates from the end laps 130, 138 at the cut lines 146 to form two corner edges 158 along each of the end panels 120, 124. Each of the corner edges 158 is disposed in the respective corners 109 of the construct 105 and defines a respective one of the engagement notches 156 (FIG. 3). As shown in FIGS. 2-5, the end flaps 130, 138, 132, 140 are glued to the respective end panels 120, 124 so that the engagement apertures 150 extend partially beyond the corner edges 158 of the respective end panels 120, 124 to provide clearance for receiving the locking tabs 148 of another construct 105. In one embodiment, as shown in FIG. 3, the engagement notches 156 can be generally aligned with the respective engagement edges 154 at each corner 109 so that the locking edges 152 of the locking tabs 148 of another construct can engage the engagement edge 154 and/or the engagement notch 156 at the respective corners 109. Alternatively, the engagement notch 156 could be proximate to the engagement apertures 150 at each corner, or the engagement notches 156 could be omitted.

Alternative assembling, loading, and closing steps may be used without departing from the scope of the disclosure. For example, the end flaps 130, 138, 132, 140 can be folded into face-to-face contact with the exterior surfaces of the respective end panels 120, 124. In addition, the construct 105 can be formed by press-forming a blank in a forming tool, or the construct 150 could be formed by other methods.

According to one embodiment, FIG. 5 shows the closed end 164 and two corners 109 of the construct 105 from the interior of the construct. The opposing corners 109 and the closed end 166 are similarly or identically configured. As shown in FIG. 5, the locking tabs 148 are disposed proximate to the respective engagement apertures 150 at each corner 109. In the illustrated embodiment, the locking tabs 148 extend outwardly from a respective end edge 160 of the respective side panels 112, 116 and along or adjacent a respective top edge 162 of the respective side panels 112, 116. Accordingly, the locking edges 152 can extend from the respective end edges 160 at the respective corners 109. Alternatively, any of the corners 109 and/or the locking features 107 could be otherwise shaped, arranged, positioned, and/or configured without departing from the disclosure.

Figure 6:
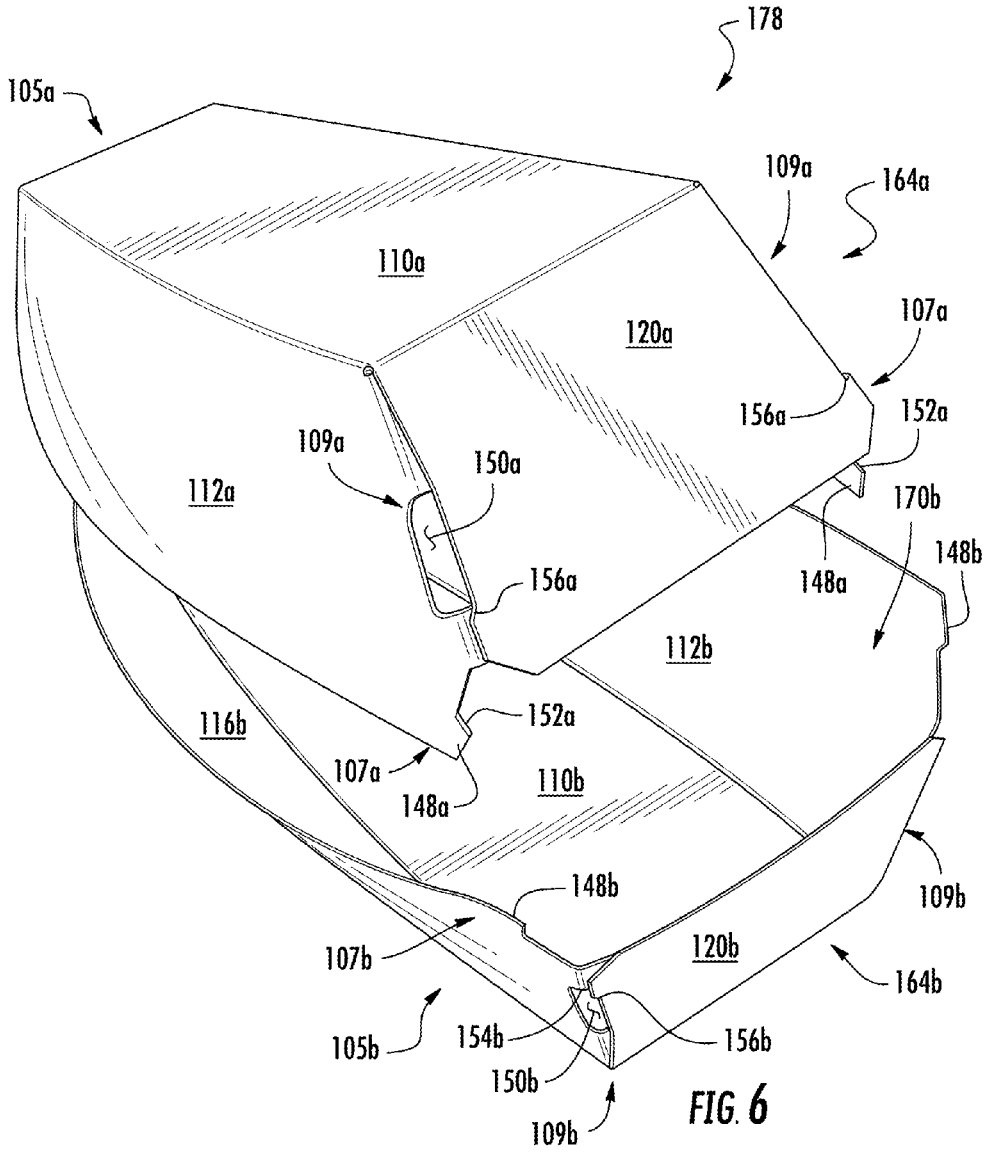
FIG. 6 is a perspective view showing the assembly of two of the constructs of FIG. 2 to form an assembly according to the exemplary embodiment of the present disclosure.
Figure 7:
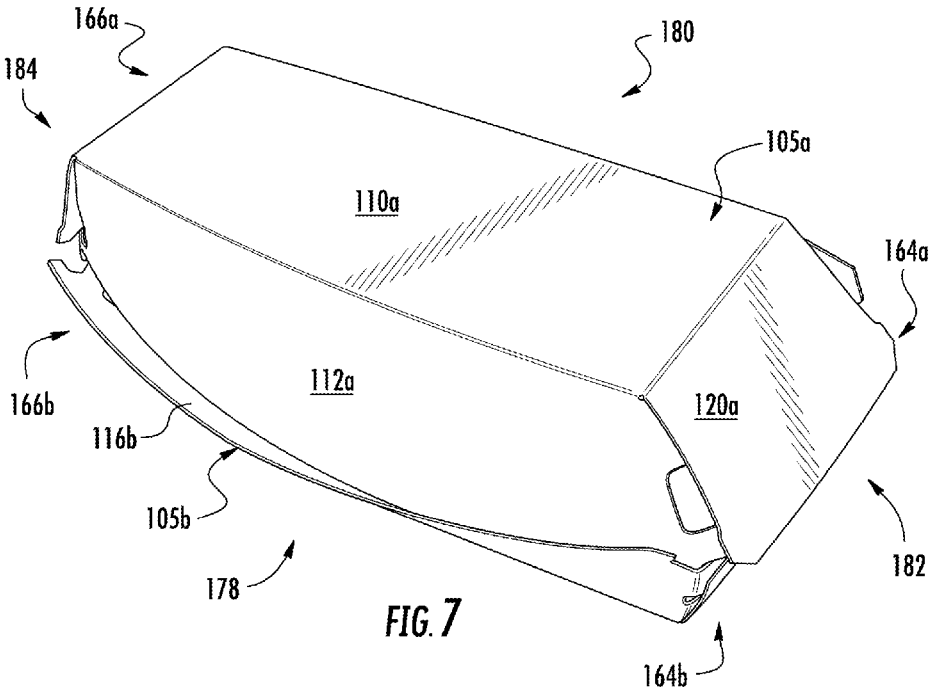
FIG. 7 is a top perspective view of the assembly according to the exemplary embodiment of the present disclosure.

As shown in FIGS. 6-9, two constructs 105, which can be selected from a stack of constructs (not shown) in one embodiment, can form the package 178 and can be assembled into an interlocking relationship to form the assembly 180. While the constructs shown in FIGS. 6-9 are generally identical, each of the constructs 105 being formed from a respective blank 103, the top construct or lid and the features thereof are indicated by an appended "a" on the reference number (e.g., the lid 105*a*), and the bottom construct or tray and the features thereof are indicated by an appended "b" on the reference number (e.g., the tray 105*b*). As shown in FIG. 6, the lid 105*a* can be positioned over the tray 105*b* with the interiors 170*a*, 170*b* of the trays directed toward one another. As shown in FIG. 7, the lid 105*a* can be moved toward the tray 105*b* so that the lid side panels 112*a*, 116*a* are generally inside the tray side panels 112*b*, 116*b* and the lid corners 109*a* are generally aligned with the respective tray corners 109*b*.

Figure 8:
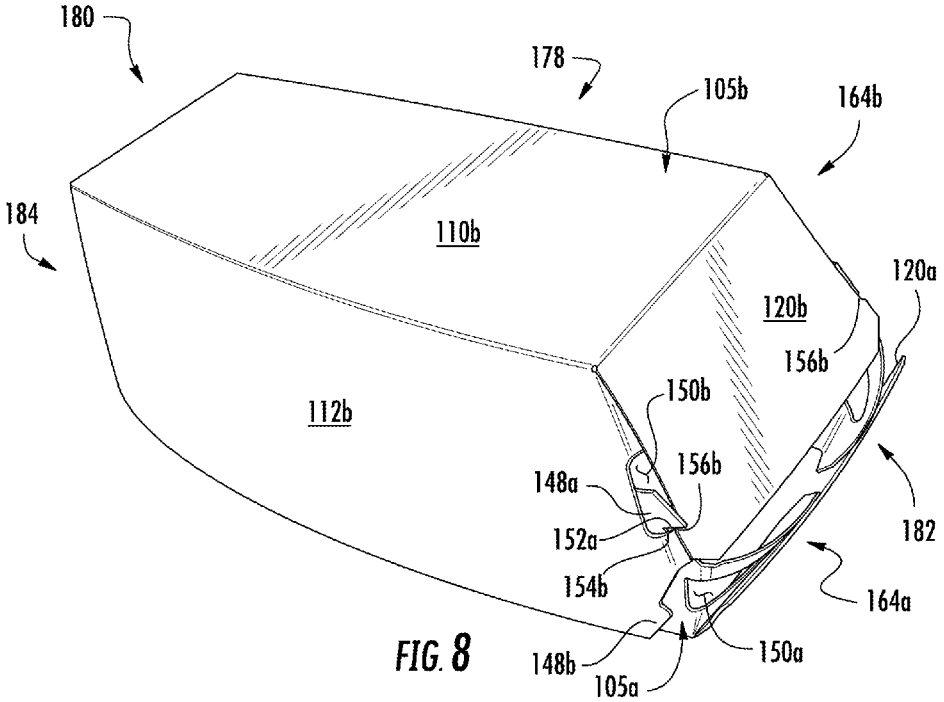
FIG. 8 is a bottom perspective view of the assembly of FIG. 7.
Figure 9:
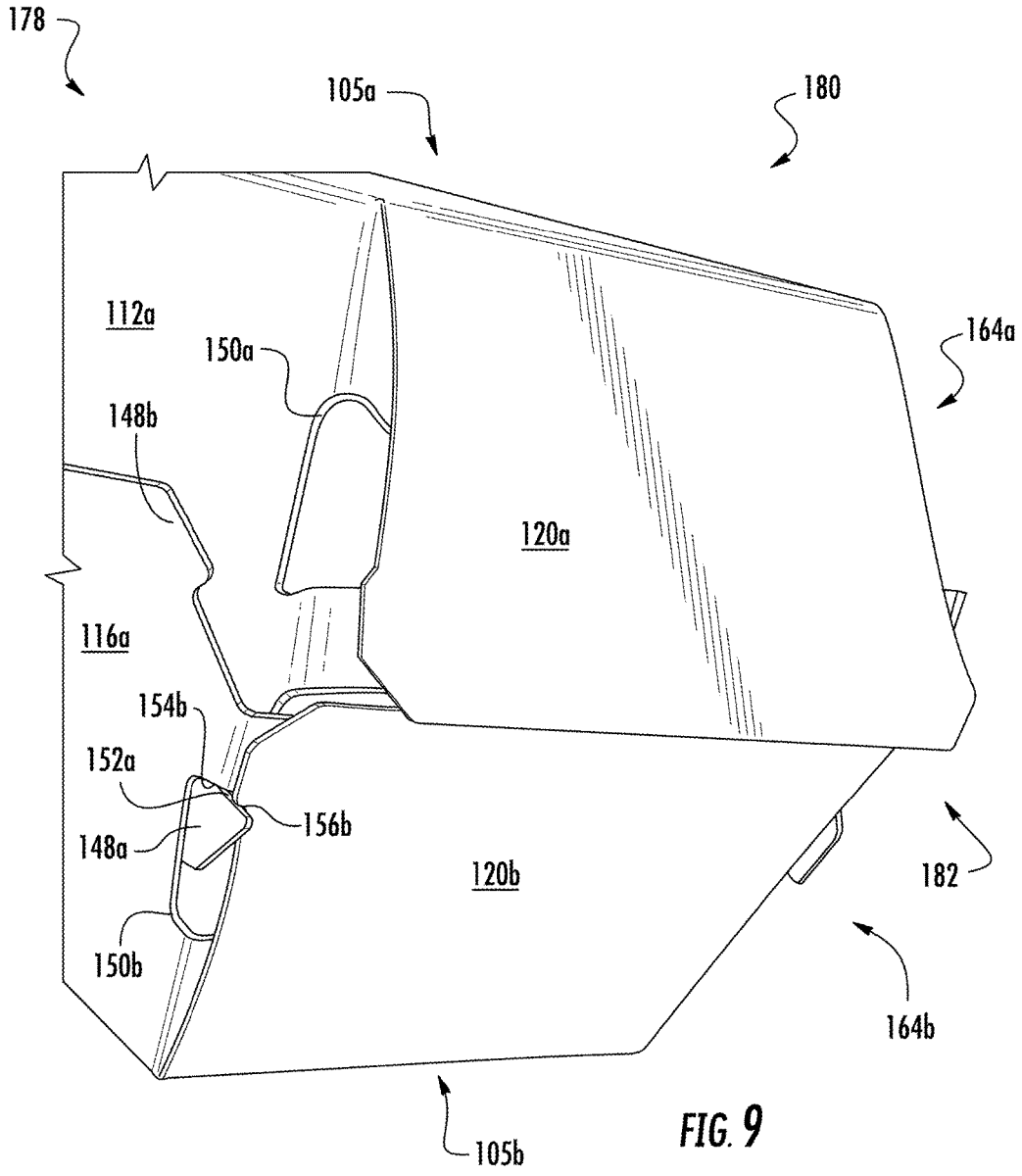
FIG. 9 is a perspective view of an end of the assembly of FIG. 7.

In the illustrated embodiment, as shown in at least FIGS. 8 and 9, the lid locking tabs 148*a* are inserted into the respective tray engagement apertures 150*b* so that each of the lid locking edges 152*a* engages the respective tray engagement edges 154*b* and/or the respective tray engagement notches 156*b* to at least partially interlock the lid 105*a* and the tray 105*b* and to help retain the lid 105*a* in the assembly with the tray 105*b*. In one embodiment, the lid 105*a* can be pivoted so that the lid locking features 107*a* at one of the lid ends 164*a*, 166*a* are interlocked with the tray locking features 107*b* at one of the tray ends 164*b*, 166*b* and then the opposing lid end is lowered to be engaged with the opposing tray end. For example, as shown in FIG. 6, the lid locking features 107*a* at the lid corners 109*a* adjacent the lid end 166*a* can be interlocked with the tray locking features 107*b* at the tray corners 109*b* adjacent the tray end 166*b*. The lid 105*a* can be pivoted so that the lid end 164*a* moves toward the tray end 164*b* and the lid locking features 107*a* at the lid corners 109*a* adjacent the lid end 164*a* can be interlocked with the tray locking features 107*b* at the tray corners 109*b* adjacent the tray end 164*b*. In the illustrated embodiment, as shown in FIGS. 7 and 8, the lid end 164*a* and the tray end 164*b* form a first end 182 of the package 178 and the assembly 180 and the lid end 166*a* and the tray end 166*b* form a second end 184 of the package 178 and the assembly 180. In an alternative embodiment, the lid ends 164*a*, 166*a* could be aligned with the respective tray ends 166*b*, 164*b*.

The assembly 180 of the tray 105*b* and the lid 105*a* is shown in FIGS. 7-9. The lid 105*a* can be removed from the tray 105*b* by disengaging the lid locking tabs 148*a* from the tray engagement apertures 150*b* and pulling the lid 105*a* away from the tray 105*b*. In one embodiment, the lid locking tabs 148*a* can be disengaged from the tray engagement apertures 150*b* by pinching the lid side panels 112*a*, 116*a* so that the lid locking tabs 148*a* at the ends of the lid side panels 112*a*, 116*a* are moved towards the tray interior 170*b* away from the tray side panels 112*b*, 116*b*. The constructs 105 can be alternatively erected and/or the assembly 180 can be alternatively formed and/or disassembled without departing from the disclosure.

In an alternative embodiment, the lid side panels 112*a*, 116*a* can be generally outside the tray side panels 112*b*, 116*b*, and the tray locking tabs 148*b* can be received in the respective lid engagement apertures 150*a* without departing from the disclosure. In one embodiment, to disengage the lid 105*a* from the tray 105*b* in this alternative configuration, the tray side panels 112*b*, 116*b* can be pinched to move the tray locking tabs 148*b* towards the lid interior 170 away from the lid side panels 112*a*, 116*a* and to disengage the tray locking tabs 148*b* from the respective lid engagement apertures 150*a*. The tray 105*b* and/or the lid 105*a* could be alternatively configured, shaped, positioned, and/or arranged without departing from the disclosure.

In the illustrated embodiment, the terms "lid" and "tray" are generally interchangeable and are used in the description and claims only to differentiate between the constructs and their features for clarity since the constructs 105*a*, 105*b* are identical, substantially identical, or generally identical. Stated another way, the assembly 180 could be inverted so that the construct 105*a* forms the "tray" on the bottom of the assembly and the construct 105*b* forms the "lid" on top of the assembly. In addition, the lid locking tabs 148*a* engaging the tray engagement apertures 150*b* as shown and described in the illustrated embodiment is essentially equivalent to the "tray" locking tabs 148*a* engaging the "lid" engagement apertures 150*b*.

In the illustrated embodiment, the construct 105 is versatile, convenient, and efficient at least because the construct 105 has both a locking tab 148 and an engagement aperture 150 at each of its corners 109 (e.g., at each end of the side panels 112, 116). Each corner 109 of the construct 105 can act as female locking feature (e.g., receiving locking tabs from a separate construct in the respective engagement apertures 150 in the construct 105) or a male locking feature (e.g., the locking tabs 148 being received in respective engagement apertures in a separate construct). Accordingly, when serving food for takeout, for example, the food product can be placed in a first construct 105 (e.g., that was taken from a stack of nested constructs, not shown), and a second construct 105 (e.g., which can be taken from the same stack as the first construct) can be interlocked with the first construct to form the assembly 180 as described above. In one embodiment, only one stack of constructs 105 is needed for the supply of lids and trays. In alternative packages where the lid is different than the tray, the lids and trays would be arranged in separate stacks that can take up valuable space. In situations where a lid is not needed, such as for when a patron is dining in at a quick-service restaurant in one example, a single construct 105 can be used as a tray to serve a food product without a lid. In contrast, in a different style of container with a lid that is different than the tray or wherein the lid is attached to the tray (e.g., a clamshell container), the unneeded lid is wasted material and takes up additional space. Accordingly, in situations where a lid is needed for the tray in some occasions and a lid is not needed for the tray in other occasions, the construct 105, which can serve as either a tray or as a lid in cooperation with another construct 105, is more convenient and efficient.

The blank 103 and/or the construct 105 and/or the assembly 180 could be otherwise shaped, arranged, positioned, and/or configured without departing from the disclosure. The blank and construct described above are included by way of example. For example, the shapes of the overall construct and/or the locking features could be any suitable shape. The shapes described above and included in the figures are included by way of example, and the construct 105 could have any suitable number of corners 109 and/or locking features 107 without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding at least one article, the package comprising:

a first construct forming a tray of the package, the tray comprising a plurality of tray panels extending at least partially around an interior of the package, a tray locking tab, and a tray engagement aperture, the plurality of tray panels comprising a tray side panel and a tray end panel and at least partially forming a tray corner, the tray locking tab extending from the tray side panel at the tray corner, the tray engagement aperture extending at the tray corner, a tray end flap is foldably connected to the tray side panel along a tray fold line, the tray fold line extends along the tray corner, and the tray engagement aperture interrupts the tray fold line;

a second construct forming a lid of the package, the lid comprising a plurality of lid panels extending at least partially around an interior of the package, a lid locking tab, and a lid engagement aperture, the plurality of lid panels comprising a lid side panel and a lid end panel and at least partially forming a lid corner, the lid locking tab extending from the lid side panel at the lid corner, the lid engagement aperture extending at the lid corner, a lid end flap is foldably connected to the lid side panel along a lid fold line, the lid fold line extends along the lid corner, and the lid engagement aperture interrupts the lid fold line;

wherein the lid locking tab and the lid engagement aperture are for selectively engaging the respective tray engagement aperture and tray locking tab to at least partially interlock the tray and the lid.

2. The package of claim 1, wherein the first construct and the second construct are substantially identical to one another.

3. The package of claim 2, wherein the first construct and the second construct are selected from a stack of substantially identical constructs.

4. The package of claim 1, wherein:

the tray locking tab extends outwardly from the tray side panel at the tray corner; and the lid locking tab extends outwardly from the lid side panel at the lid corner.

5. The package of claim 4, wherein the tray engagement aperture and the lid engagement aperture extend in the respective tray end flap and lid end flap at the respective tray corner and lid corner.

6. The package of claim 5, wherein the tray end panel and the tray end flap at least partially overlap one another at an end of the package, the lid end panel and the lid end flap at least partially overlap one another at the end of the package, and each of the tray end panel and the lid end panel comprises a respective engagement notch at least partially aligned with the respective tray engagement aperture and lid engagement aperture in the respective tray end flap and lid end flap.

7. The package of claim 4, wherein the tray locking tab and the lid locking tab extend from respective end edges of the respective tray side panel and lid side panel, the end edges extending generally upwardly from the respective tray fold line and the lid fold line.

8. The package of claim 7, wherein the tray side panel and the lid side panel comprise respective top edges, the tray locking tab and the lid locking tab extending adjacent the respective top edge of the respective tray side panel and lid side panel.

9. The package of claim 1, wherein the tray end panel and the lid end panel respectively comprise a tray engagement notch and a lid engagement notch at the respective tray corner and lid corner, the tray locking tab and the lid locking tab being for selectively engaging the respective lid engagement notch and tray engagement notch to at least partially interlock the tray and the lid.

10. The package of claim 1, wherein:

the tray corner is a first tray corner, the tray locking tab is a first tray locking tab, the tray engagement aperture is a first tray engagement aperture, the lid corner is a first lid corner, the lid locking tab is a first lid locking tab, and the lid engagement aperture is a first lid engagement aperture;

the plurality of tray panels at least partially forms a second tray corner, and the tray further comprises a second tray locking tab and a second tray engagement aperture, the second tray locking tab and the second tray engagement aperture extending at the second tray corner;

the plurality of lid panels at least partially forms a second lid corner, and the lid further comprises a second lid locking tab and a second lid engagement aperture, the second lid locking tab and the second lid engagement aperture extending at the second lid corner; and the second lid locking tab and the second lid engagement aperture are for selectively engaging the respective second tray engagement aperture and second tray locking tab to at least partially interlock the tray and the lid.

11. The package of claim 10, wherein:

the tray side panel is a first tray side panel, the plurality of tray panels further comprises a second tray side panel, the first tray locking tab extends outwardly from the first tray side panel at the first tray corner, and the second tray locking tab extends outwardly from the second tray side panel at the second tray corner; and the lid side panel is a first lid side panel, the plurality of lid panels further comprises a second lid side panel, the first lid locking tab extends outwardly from the first lid side panel at the first lid corner, and the second lid locking tab extends outwardly from the second lid side panel at the second lid corner.

12. The package of claim 11, wherein the tray end flap is a first tray end flap, a second tray end flap is foldably connected to the second tray side panel at the second tray corner, and the first tray engagement aperture and the second tray engagement aperture extend in the respective first tray end flap and second tray end flap at the respective first tray corner and second tray corner; and the lid end flap is a first lid end flap, a second lid end flap is foldably connected to the respective first lid side panel and second lid side panel at the respective first lid corner and second lid corner, and the first lid engagement aperture and the second lid engagement aperture extend in the respective first lid end flap and second lid end flap at the respective first lid corner and second lid corner.

13. The package of claim 12, wherein the tray end panel is at least partially overlapped with the first tray end flap and the second tray end flap, and the lid end panel is at least partially overlapped with the first lid end flap and the second lid end flap.

14. The package of claim 11, wherein the tray end panel extends from the first tray corner to the second tray corner, and the lid end panel extends from the first lid corner to the second lid corner.

15. The package of claim 10, wherein:

the tray side panel extends from the first tray corner to the second tray corner, the first tray locking tab and the second tray locking tab extend from respective ends of the tray side panel at the respective first tray corner and second tray corner; and the lid side panel extends from the first lid corner to the second lid corner, the first lid locking tab and the second lid locking tab extending from respective ends of the lid side panel at the respective first lid corner and second lid corner.

16. The package of claim 15, wherein:

the tray end flap is a first tray end flap, the first tray end flap and a second tray end flap are foldably connected to the respective ends of the tray side panel at the respective first tray corner and second tray corner, and the first tray engagement aperture and the second tray engagement aperture extend in the respective first tray end flap and second tray end flap at the respective first tray corner and second tray corner; and the lid end flap is a first lid end flap, the first lid end flap and a second lid end flap are foldably connected to the respective ends of the lid side panel at the respective first lid corner and second lid corner, and the first lid engagement aperture and the second lid engagement aperture extend in the respective first lid end flap and second lid end flap at the respective first lid corner and second lid corner.

17. The package of claim 16, wherein:

the tray end panel is a first tray end panel, and the plurality of tray panels further comprises a second tray end panel, the first tray end flap and the first tray end panel are at least partially overlapped with one another at a first end of the package, and the second tray end flap and the second tray end panel are at least partially overlapped with one another at a second end of the package; and the lid end panel is a first lid end panel, and the plurality of lid panels further comprises a second lid end panel, the first lid end flap and the first lid end panel are at least partially overlapped with one another at the first end of the package, and the second lid end flap and the second lid end panel are at least partially overlapped with one another at the second end of the package.

18. The package of claim 10, wherein:

each of the first tray corner, the second tray corner, the first lid corner, and the second lid corner is disposed at a first end of the package;

the plurality of tray panels at least partially form third tray corner and a fourth tray corner, each disposed at a second end of the package, the tray further comprises a third tray locking tab, a third tray engagement aperture, a fourth tray locking tab, and a fourth tray engagement aperture, the third tray locking tab and a third tray engagement aperture extending at the third tray corner, and the fourth tray locking tab and the fourth tray engagement aperture extending at the fourth tray corner;

the plurality of lid panels at least partially form third lid corner and a fourth lid corner, each disposed at the second end of the package, the lid further comprises a third lid locking tab, a third lid engagement aperture, a fourth lid locking tab, and a fourth lid engagement aperture, the third lid locking tab and a third lid engagement aperture extending at the third lid corner, and the fourth lid locking tab and the fourth lid engagement aperture extending at the fourth lid corner; and the third lid locking tab, the third lid engagement aperture, the fourth lid locking tab, and the fourth lid engagement aperture are for selectively engaging the respective third tray engagement aperture, third tray locking tab, fourth tray engagement aperture, and fourth tray locking tab to at least partially interlock the tray and the lid.

19. The package of claim 1, wherein one of the lid locking tab and the lid engagement aperture is at least partially engaged with the respective tray engagement aperture and tray locking tab to at least partially interlock the tray and the lid.

20. The package of claim 1, wherein the tray end panel partially overlies the tray engagement aperture.

21. The package of claim 1, wherein the lid end panel partially overlies the lid engagement aperture.

22. A blank for forming a construct for holding at least one article, the blank comprising:

a plurality of panels for being disposed at least partially around an interior of the construct formed from the blank to at least partially form a corner of the construct formed from the blank, the plurality of panels comprising a side panel and an end panel;

locking features for at least partially interlocking the construct formed from the blank with a separate construct, the locking features comprising at least a locking tab and an engagement aperture, the locking tab extending from the side panel, the locking tab being proximate the engagement aperture at the corner when the construct is formed from the blank; and an end flap foldably connected to the side panel along a fold line, the end panel at least partially overlapping the end flap when the construct is formed from the blank, the fold line extends along the corner when the construct is formed from the blank, an end edge of the side panel extends from the end flap to the locking tab, and the engagement aperture extends in the side panel and the end flap and interrupts the fold line.

23. The blank of claim 22, wherein the corner is a first corner, the side panel is a first side panel, and the end flap is a first end flap, the plurality of panels further comprises a second side panel, a second end flap is foldably connected to the second side panel, the end panel and the second end flap at least partially overlap one another, and the second side panel and the second end flap are for at least partially defining a second corner of the construct formed from the blank.

24. The blank of claim 23, wherein the locking tab is a first locking tab and the engagement aperture is a first engagement aperture, and the locking features further comprise a second locking tab and a second engagement aperture, the second locking tab being proximate the second engagement aperture at the second corner of the construct when the construct is formed from the blank.

25. The blank of claim 24, wherein:

the end panel is a first end panel, and the plurality of panels comprises a second end panel for being disposed opposite to the first end panel when the construct is formed from the blank;

a third end flap is foldably connected to the first side panel, a fourth end flap is foldably connected to the second side panel, the second end panel and each of the third end flap and the fourth end flap are for respectively at least partially overlapping one another when the construct is formed from the blank;

the first side panel and the third end flap at least partially define a third corner of the construct formed from the blank, and the second side panel and the fourth end flap at least partially define a fourth corner of the construct formed from the blank; and the locking features further comprises a third locking tab, a third engagement aperture, a fourth locking tab, and a fourth engagement aperture, the third locking tab being for extending proximate the third engagement aperture at the third corner when the construct is formed from the blank, and the fourth locking tab being for extending proximate the fourth engagement aperture at the fourth corner when the construct is formed from the blank.

26. The blank of claim 22, wherein the side panel comprises a top edge, and the locking tab extends outwardly from the end edge of the side panel adjacent the top edge of the side panel.

27. The blank of claim 26, wherein the end edge is for extending in the corner of the construct formed from the blank, and the top edge is for extending away from the corner when the construct is formed from the blank.

28. The blank of claim 26, wherein the locking tab comprises a locking edge extending from the end edge of the side panel.

29. The blank of claim 22, wherein the locking tab extends from the side panel, the end panel comprises a corner edge, the corner edge is for extending adjacent the corner when the construct is formed from the blank, and the locking features further comprise an engagement notch in the corner edge of the end panel.

30. The blank of claim 29, wherein the engagement aperture comprises an engagement edge, and the engagement notch is for being generally aligned with the engagement edge of the engagement aperture when the construct is formed from the blank.

31. The blank of claim 22, wherein, the locking tab extends outwardly from the end edge, the locking tab is spaced apart from the end flap by the end edge, and the end edge is for extending at the corner when the construct is formed from the blank.

32. The blank of claim 22, wherein the end panel partially overlies the tray engagement aperture when the construct is formed from the blank.

33. A method of forming a construct, the method comprising:

obtaining a blank comprising a plurality of panels and locking features, the plurality of panels comprising a side panel, an end panel, and an end flap, the end flap being foldably connected to the side panel along a fold line, and the locking features comprising at least a locking tab and an engagement aperture, the locking tab extending from the side panel, an end edge of the side panel extends from the end flap to the locking tab, and the engagement aperture extends in the side panel and the end flap and interrupts the fold line;

positioning the panels of the plurality of panels to extend at least partially around an interior of the construct, the positioning the panels comprises forming a corner of the construct and at least partially overlapping the end panel and the end flap, wherein the locking tab is proximate the engagement aperture at the corner of the construct, and the fold line extends along the corner of the construct.

34. The method of claim 33, wherein the positioning the panels comprises folding the end flap with respect to the side panel to at least partially define the corner of the construct.

35. The method of claim 34, wherein the corner is a first corner, the side panel is a first side panel, and the end flap is a first end flap, the plurality of panels further comprises a second side panel, a second end flap is foldably connected to the second side panel, the positioning the panels further comprises folding the second end flap with respect to the second side panel to at least partially define the second corner of the construct and positioning the end panel and the second end flap to at least partially overlap one another.

36. The method of claim 35, wherein the locking tab is a first locking tab and the engagement aperture is a first engagement aperture, and the locking features further comprise a second locking tab and a second engagement aperture, the second locking tab being proximate the second engagement aperture at the second corner of the construct.

37. The method of claim 33, wherein the positioning the panels comprises positioning the end panel to partially overlie the engagement aperture.

38. A method of forming an assembly, the method comprising:

obtaining a first construct and a second construct, wherein the first construct forms a tray of the assembly, the tray comprising a plurality of tray panels extending at least partially around an interior of the assembly, a tray locking tab, and a tray engagement aperture, the plurality of tray panels comprising a tray side panel, a tray end panel, and a tray end flap at least partially forming a tray corner, the tray locking tab extending from the tray side panel at the tray corner, the tray engagement aperture extending at the tray corner, the tray end flap being foldably connected to the tray side panel along a tray fold line, the tray fold line extending along the tray corner, and the tray engagement aperture interrupting the tray fold line, and the second construct forms a lid of the assembly, the lid comprising a plurality of lid panels extending at least partially around an interior of the assembly, a lid locking tab, and a lid engagement aperture, the plurality of lid panels comprising a lid side panel, a lid end panel, and a lid end flap at least partially forming a lid corner, the lid locking tab extending from the lid side panel of the plurality of lid panels at the lid corner, and the lid engagement aperture extending at the lid corner, the lid end flap being foldably connected to the lid side panel along a lid fold line, the lid fold line extending along the lid corner, and the lid engagement aperture interrupting the lid fold line; and at least partially interlocking the first construct with the second construct by disposing at least one of the lid locking tab and the tray locking tab to be at least partially received in the respective tray engagement aperture and lid engagement aperture.

39. The method of claim 38, wherein the at least partially interlocking the first construct with the second construct comprises engaging a locking edge of the lid locking tab with an engagement edge of the tray engagement aperture.

40. The method of claim 38, wherein the first construct and the second construct are generally identical to one another, and the obtaining the first construct and the second construct comprises selecting each of the first construct and the second construct from a stack of generally identical constructs.

41. The method of claim 38, wherein:

the tray locking tab extends outwardly from the tray side panel at the tray corner, and the tray engagement aperture extends in the tray end flap at the tray corner; and the lid locking tab extends outwardly from the lid side panel at the lid corner, and the lid engagement aperture extends in the lid end flap at the lid corner.

42. The method of claim 41, wherein:

each of the tray end panel and the lid end panel comprises a respective engagement notch;

the tray end panel and the tray end flap at least partially overlap one another at an end of the package, the lid end panel and the lid end flap at least partially overlap one another at the end of the package, and the engagement notches of the tray end panel and the lid end panel are disposed adjacent the respective tray engagement aperture and lid engagement aperture in the respective tray end flap and lid end flap; and the at least partially interlocking the first construct with the second construct further comprises engaging the lid locking tab with at least one of the tray engagement aperture and the engagement notch of the tray end panel.

43. The method of claim 42, wherein the tray engagement aperture comprises an engagement edge, the engagement notch of the tray end panel is at least partially aligned with the engagement edge of the tray engagement aperture, and the engaging the lid locking tab with at least one of the tray engagement aperture and the engagement notch of the tray end panel further comprises engaging the lid locking tab with each of the engagement edge of the tray engagement aperture and the engagement notch of the tray end panel.

44. The method of claim 38, wherein:

the tray corner is a first tray corner, the tray locking tab is a first tray locking tab, the tray engagement aperture is a first tray engagement aperture, the lid corner is a first lid corner, the lid locking tab is a first lid locking tab, and the lid engagement aperture is a first lid engagement aperture;

the plurality of tray panels at least partially forms a second tray corner, the tray further comprises a second tray locking tab and a second tray engagement aperture, the second tray locking tab and the second tray engagement aperture extending at the second tray corner;

the plurality of lid panels at least partially forms a second lid corner, the lid further comprises a second lid locking tab and a second lid engagement aperture, the second lid locking tab and the second lid engagement aperture extending at the second lid corner; and the at least partially interlocking the first construct with the second construct further comprises disposing at least one of the second lid locking tab and the second tray locking tab to be at least partially received in the respective second tray engagement aperture and second lid engagement aperture.

45. The method of claim 38, wherein the tray end panel partially overlies the tray engagement aperture.

46. The method of claim 38, wherein the lid end panel partially overlies the lid engagement aperture.

47. A construct for holding at least one article, the construct comprising:

a plurality of panels extending at least partially around an interior of the construct, the plurality of panels comprising a side panel and an end panel and at least partially forming a corner of the construct;

an end flap foldably connected to the side panel along a fold line, the end panel at least partially overlapping the end flap at an end of the construct, the fold line extending along the corner of the construct; and locking features for at least partially interlocking the construct with a separate construct, the locking features comprising at least a locking tab and an engagement aperture, the locking tab extending from the side panel, an end edge of the side panel extending from the end flap to the locking tab, and the engagement aperture extending in the side panel and the end flap and interrupting the fold line.

48. The construct of claim 47, wherein the end panel partially overlies the engagement aperture.

49. The construct of claim 47, wherein the locking tab comprises a locking edge, and the end edge of the side panel extends from an end of the fold line to the locking edge.

50. The construct of claim 49, wherein the locking edge is oblique with respect to the end edge.

51. The construct of claim 47, wherein the corner is a first corner, the side panel is a first side panel, and the end flap is a first end flap, the plurality of panels further comprises a second side panel, a second end flap is foldably connected to the second side panel, the end panel and the second end flap at least partially overlap one another, and the second side panel and the second end flap at least partially define a second corner of the construct.

52. The construct of claim 51, wherein the locking tab is a first locking tab, the engagement aperture is a first engagement aperture, and the locking features further comprise a second locking tab and a second engagement aperture, the second locking tab and the second engagement aperture extending at the second corner of the construct.

53. The construct of claim 52, wherein:

the end panel is a first end panel, and the plurality of panels comprises a second end panel disposed opposite to the first end panel;

a third end flap is foldably connected to the first side panel, a fourth end flap is foldably connected to the second side panel, and the second end panel and each of the third end flap and the fourth end flap respectively at least partially overlap one another;

the first side panel and the third end flap at least partially define a third corner of the construct, and the second side panel and the fourth end flap at least partially define a fourth corner of the construct; and the locking features further comprise a third locking tab, a third engagement aperture, a fourth locking tab, and a fourth engagement aperture, the third locking tab and the third engagement aperture extending at the third corner of the construct, and the fourth locking tab and the fourth engagement aperture extending at the fourth corner of the construct.

54. The construct of claim 47, wherein the side panel comprises a top edge and the locking tab extends outwardly from the end edge adjacent the top edge.

55. The construct of claim 47, wherein the end panel comprises a corner edge extending adjacent the corner of the construct, and the locking features further comprise an engagement notch in the corner edge of the end panel.

56. The construct of claim 55, wherein the engagement aperture comprises an engagement edge and the engagement notch is generally aligned with the engagement edge of the engagement aperture.

57. The construct of claim 47, wherein the locking tab is spaced apart from the end flap by the end edge.

* * * * *